US010242825B1

(12) United States Patent
Kowalik et al.

(10) Patent No.: US 10,242,825 B1
(45) Date of Patent: Mar. 26, 2019

(54) HIGH VOLTAGE SWITCH VACUUM INTERRUPTER

(71) Applicants: Peter M. Kowalik, Trafford, PA (US); Daniel J. Wolfe, Trafford, PA (US)

(72) Inventors: Peter M. Kowalik, Trafford, PA (US); Daniel J. Wolfe, Trafford, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 113 days.

(21) Appl. No.: 14/828,785

(22) Filed: Aug. 18, 2015

Related U.S. Application Data

(60) Provisional application No. 62/050,805, filed on Sep. 16, 2014.

(51) Int. Cl.
*H01H 33/662* (2006.01)
*H01H 33/666* (2006.01)

(52) U.S. Cl.
CPC .. *H01H 33/66207* (2013.01); *H01H 33/6664* (2013.01); *H01H 2033/6665* (2013.01); *H01H 2033/66223* (2013.01); *H01H 2235/01* (2013.01)

(58) Field of Classification Search
CPC ..... H01H 33/66207; H01H 33/6664; H01H 2235/01; H01H 2033/6665; H01H 2033/66223
See application file for complete search history.

(56) References Cited

U.S. PATENT DOCUMENTS 3,571,543 A * 3/1971 Perkins ..... H01H 33/6661 218/10
4,319,105 A * 3/1982 Lott ..... H01H 33/128 200/271
4,492,835 A 1/1985 Turner
4,562,324 A * 12/1985 Hall ..... H01H 1/385 200/253.1
8,734,573 B2 5/2014 Ono et al.
9,023,539 B2 * 5/2015 Chen Wang ..... H01M 4/06 429/405
2008/0197008 A1 * 8/2008 Einschenk ..... H01H 33/6661 200/48 R (Continued)

*Primary Examiner* — Edwin A. Leon
*Assistant Examiner* — Lheiren Mae A Caroc
(74) *Attorney, Agent, or Firm* — Ronald S. Lombard

(57) ABSTRACT

A vacuum interrupter for a high voltage air break switch is disclosed. The interrupter has a plurality of load interrupter contacts enclosed in axially aligned vacuum bottles, each bottle containing a fixed contact and a second contact movable axially away from the fixed contact to open position and toward the fixed contact to closed position. The bottles are positioned in an tubular housing of dielectric material having a top end member and a bottom end member. The vacuum bottles are mechanically coupled to one another in a stack with the top bottle supported by the top end member. At least one air permeable hydrophobic vent member is operatively disposed in the top end member and/or bottom end member and/or tubular housing to prevent condensation in the housing. The stack of vacuum bottles are axially supported at the bottom by a cushion spring assembly keeping the bottles in compression to prevent tension loads on the braze joints of the bottles.

6 Claims, 7 Drawing Sheets

(56) References Cited

U.S. PATENT DOCUMENTS

| | | | | |
|---|---|---|---|---|
| 2013/0033830 | A1* | 2/2013 | Eckhardt | G01L 19/003 361/753 |
| 2013/0146433 | A1* | 6/2013 | Reuber | H01H 1/385 200/48 R |
| 2014/0291293 | A1* | 10/2014 | Gentsch | H01H 33/66207 218/139 |

* cited by examiner

HIGH VOLTAGE SWITCH VACUUM INTERRUPTER

CROSS-REFERENCE TO RELATED APPLICATION

This is application claims the benefit of U.S. Provisional Application No. 62/050,805 filed Sep. 16, 2014, which is incorporated herein by reference in its entirety.

BACKGROUND OF THE INVENTION

The present invention relates to a vacuum interrupter for a high voltage disconnect switch. And, in particular, to a vacuum interrupter assembly for a high voltage disconnect switch composed of a number of vacuum bottles mechanically ganged together in a stacked array and operated by a spring mechanism to interrupt high voltage currents using multiple contact gaps of the multiple vacuum bottles connected in series circuit arrangement. These vacuum bottles are enclosed in an insulating tube made of dielectric material together with the spring mechanism. The insulating member has end members at both ends of the tube to seal off the tube. The total voltage to be interrupted is applied across the series of bottles within the insulating tube. Traditionally this tube is filled with insulating medium of oil, $SF_6$ (sulfur hexafluoride) gas, nitrogen or the use of desiccant to keep the inside of the tube free of water or excess humidity that could cause the bottles electrically to flash over under the high voltage within the tube.

It has been recognized that with an insulating medium such as $SF_6$ gas there is a global warming potential greater than other insulating mediums. Also, the insulating mediums are often pressurized which potentially could cause problems if a leak developed in the insulating tube.

The vacuum bottles typically have the outer container made of ceramic having braze joints. It has been found that problems may arise especially in the braze joints when the bottles are stressed due to tension while the operating mechanism opens and closes the contacts.

U.S. Pat. No. 4,492,835 by John L. Turner, issued Jan. 8, 1985, describes a typical high voltage load interrupter device having a plurality of load interrupter contacts enclosed respectively in axially aligned vacuum bottles, each bottle containing a fixed contact and a second contact movable axially away from the fixed contact to open position and toward the fixed contact to closed position by an actuating mechanism. The bottles are positioned in a tubular housing of dielectric material by a series of stacking pedestals each formed with three equi-angularity spaced radial arms engaging the inner surface of the tubular housing. Each movable contact is normally resiliently biased toward closed position and is moved to open position by a toggle of the actuating mechanism having a pair of arms substantially aligned with the contacts and held in position by springs connected to arms on the operating shaft such that when the operating shaft is rotated by the operating arm, the above-mentioned springs break the toggle, causing the individual contacts to open. A reset spring returns the operating shaft and operating arm to ready position and causes the toggle to return the contacts to their normal closed positions. The Turner patent in order to keep the interior of the interrupter device dry uses nitrogen at a predetermined pressure on the order of 5 PSI.

It is therefore an object of the present invention to develop a vacuum interrupter for a high voltage switch that eliminates the necessity of using the aforementioned insulating mediums, i.e., insulating medium of oil, $SF_6$ (sulfur hexafluoride) gas, nitrogen within the elongated housing or tube of dielectric material that houses the vacuum bottles as described for prior vacuum circuit interrupter's or the necessity of using a desiccant to keep to the inside of the tube free of water or excess humidity that could cause the bottles to electrically flash over under the high voltage within the tube. It is also an object of this invention to develop a vacuum interrupter for a high voltage switch that assures the vacuum bottles are maintained in compression rather then tension to eliminate undesirable stresses on the braze joints of the bottles.

SUMMARY OF THE INVENTION

The present invention provides a high voltage switch vacuum interrupter which uses atmospheric air as the insulating medium of the elongated housing or tube. The invention utilizes an air permeable membrane that is inherently liquid repellent. The membrane allows air to flow but prevents water and other liquids from entering the interior of the insulating tube and prevents condensation in the housing. The membrane allows water vapor to flow in or out of the insulating tube, but the flow-in is so slow that warm humid air does not condense on a cold vacuum bottle surface inside the insulating tube as shown by repeated tests in an environmental chamber. The prevention of condensation on the vacuum bottles assures that electric flash over of the vacuum bottles will not occur. The air permeable membrane is affixed in an aperture passing through one or more ends of the insulating tube. The membrane allows air flow to equalize the pressure inside the insulating tube to the ambient pressure outside the tube. The vacuum interrupter housing of the present invention has no gas to leak out as is possible in previous interrupters and prevents condensation and water from entering the insulating tube which over time may also cause a voltage failure of the insulating tube. There has been a history of these failures due to condensation on the bottle surface or desiccant becoming saturated with moisture, or gas leaking out. Also, there has been a history of fire hazard from insulating oils being used in the tubes.

In a further aspect of the present invention the stack of multiple axially aligned vacuum bottles are held in compression by a cushion spring assembly placed in operative arrangement at one end of the stack. It has been found that this arrangement with the cushion spring assembly assures that the braze joints of the individual vacuum bottles are not loaded in tension during the mechanism operation to open and close the contacts contained in the bottles at high speed. This has been found important to prevent leaks in the vacuum tight joints of each bottle due to tensile loads. If the vacuum is lost or even slowly leaks from a bottle the interrupter will fail. In addition, the spring assembly isolates the bottles from shock loads during shipping of the interrupter.

BRIEF DESCRIPTION OF THE DRAWINGS

Further details of the invention will become clear from the following descriptions of the illustrative embodiments represented schematically in the drawings, in which.

DETAILED DESCRIPTION OF THE PARTICULAR EMBODIMENTS

Figure 1:
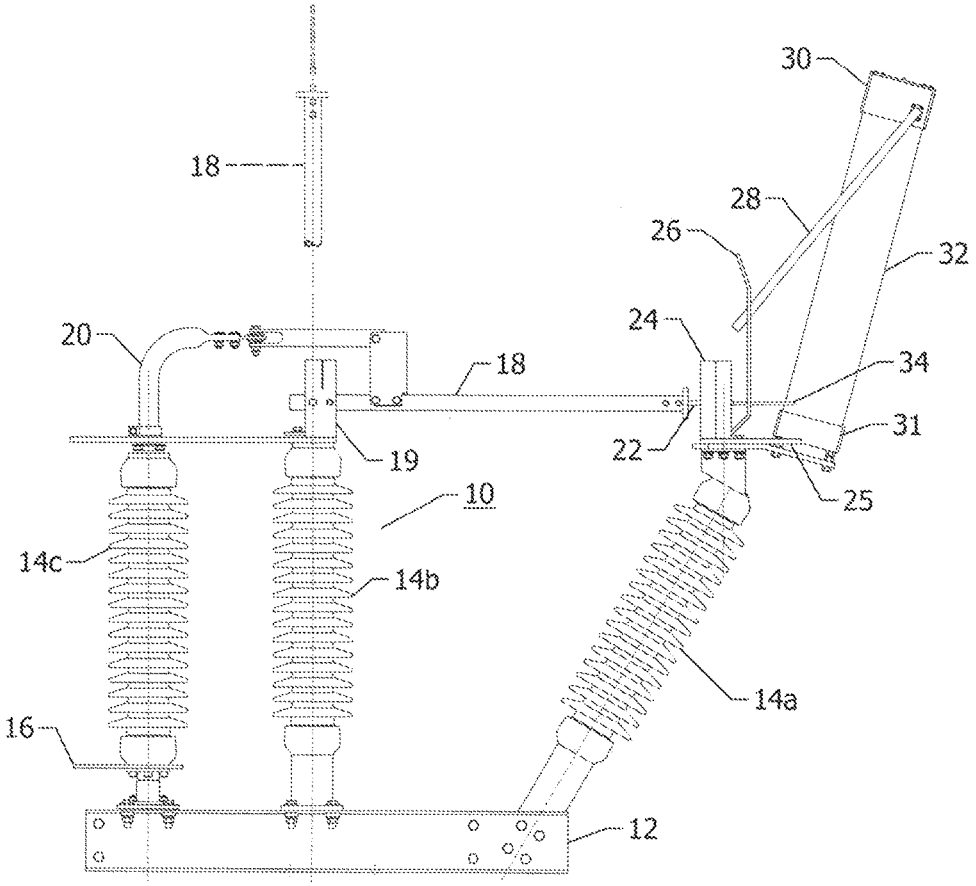
FIG. 1 is a side elevation view of a high voltage vertical break disconnect switch with a vacuum interrupter of the present invention showing the switch blade in the closed operating position and dashed lines showing the switch blade in the open position.
Figure 5:
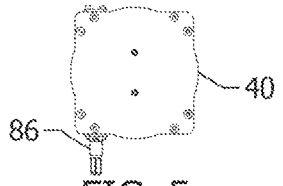
FIG. 5 is a plan view of FIG. 4.
Figure 6:
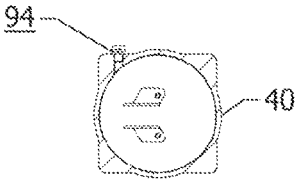
FIG. 6 is a sectional view taken along the line VI-VI of FIG. 2.
Figure 2:
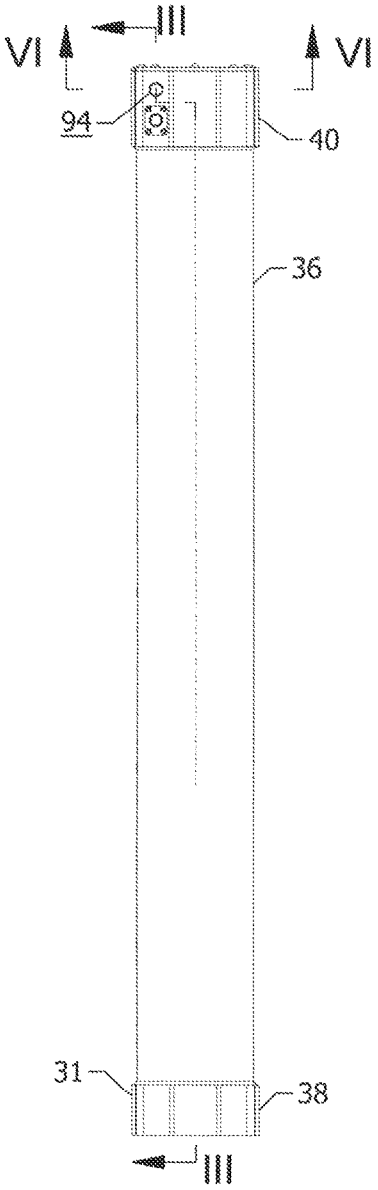
FIG. 2 is a side elevation view of the vacuum interrupter unattached to the high voltage switch without the actuating arm.

FIG. 1 shows a high voltage disconnect switch 10 which in this embodiment is depicted as a vertical break switch. Of course, the present invention applies equally to other iterations of a high voltage disconnect switch, such as, a side break switch or a center break switch, for example. The vertical high voltage disconnect switch depicted in FIG. 1, includes a base 12 to which is attached two stationary insulators 14*a* and 14*b* and a rotatable insulator 14*c*. The switch blade 18 is hinged to hinge 19. A lever 16 is attached to the bottom of the rotatable insulator 14*c* by which a force can be exerted either manually or by motor mechanism to rotate the insulator 14*c* and cause the high voltage disconnect switch to open a switch blade 18. Extending from the top of the rotatable insulator 14*c* an operating crank 20 is attached to the switch blade 18 as shown in FIG. 1. When lever 16 is caused to rotate the operating crank 20 imparts a motion to the switch blade 18 to cause it to raise vertically as shown by the dashed lines to cause blade contact 22 to be released from contact with the jaw fingers 24. A stationary arc horn 26 is in sliding contact with the moving arc horn contact 34. As the switch 10 is open the stationary arc horn 26 which had been in contact with moving arc horn 34 attached to the switch blade 18 is caused to slide out of contact with the stationary arc horn 24. As the switch blade 18 rotates the moving arc horn 34 is brought into operative engagement with an actuating arm 28 of the vacuum interrupter 32 for tripping the toggle mechanism of the vacuum interrupter 32 for extinguishing the arc inside the vacuum bottles. Such an arrangement is well known in the art.

Figure 3:
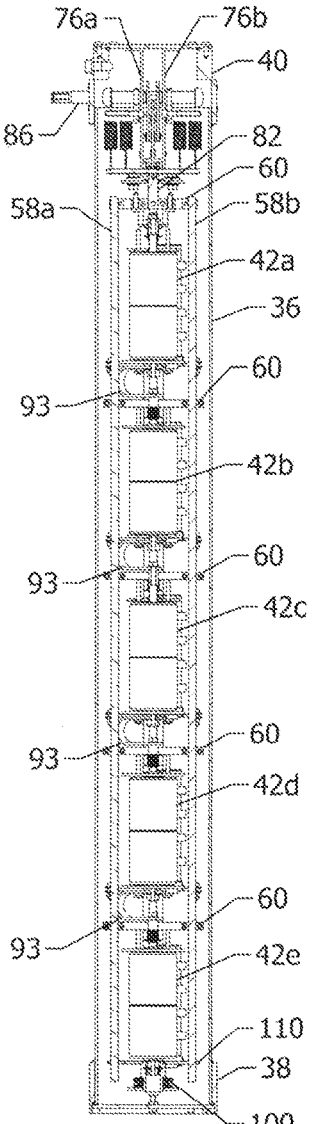
FIG. 3 is a sectional view taken along the line III-III of FIG. 2.
Figure 4:
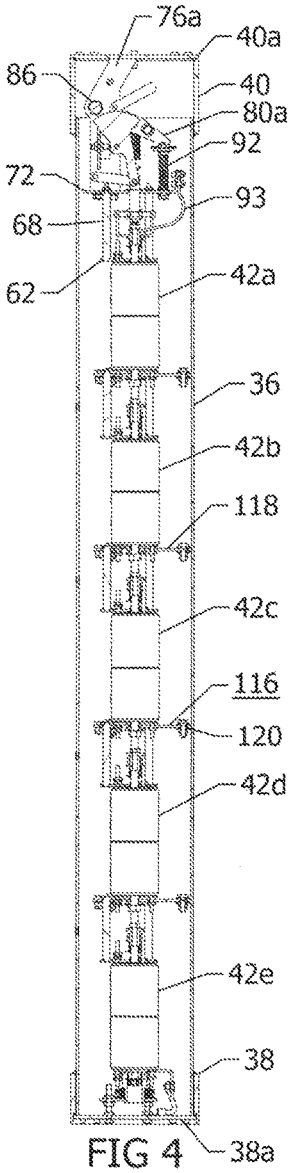
FIG. 4 is the view of FIG. 3 rotated 90 degrees.
Figure 9:
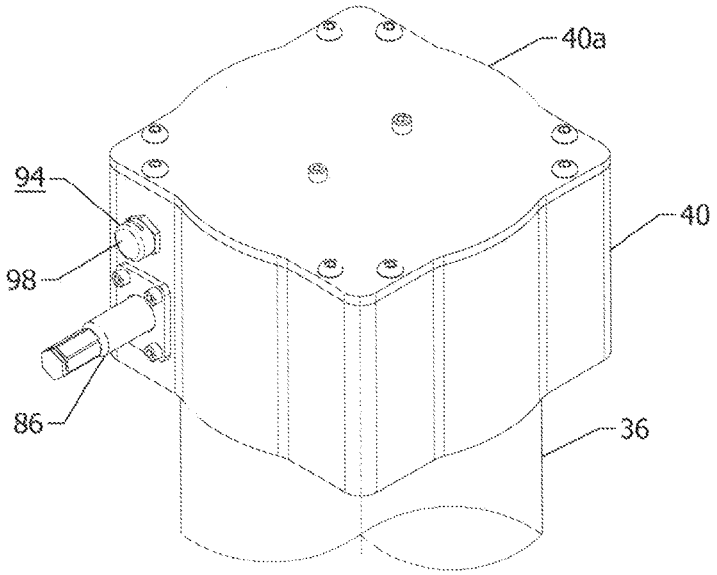
FIG. 9 is a perspective view of the same as FIG. 7.
Figure 7:
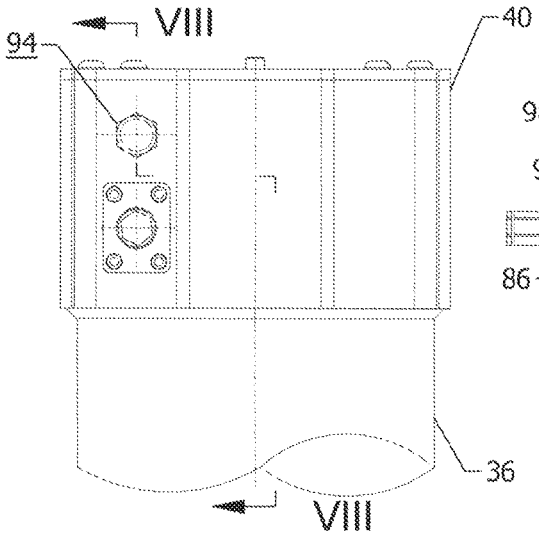
FIG. 7 is an enlarged view of a portion of FIG. 2 of the top cover showing the vent containing the air permeable membrane.
Figure 8:
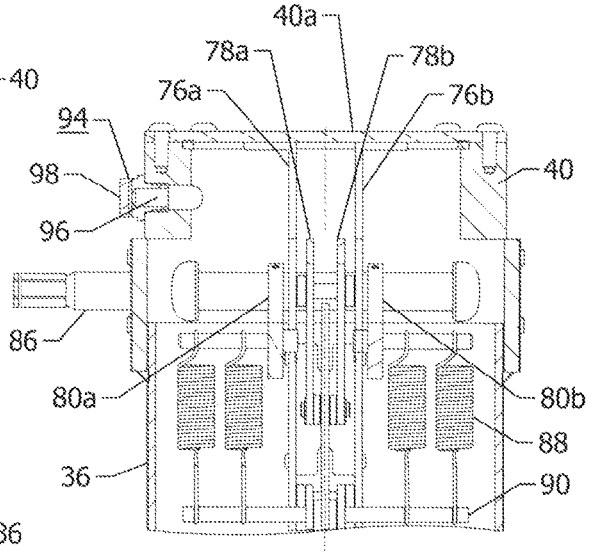
FIG. 8 is a sectional view taken along the line VIII-VIII of FIG. 7.
Figure 10:
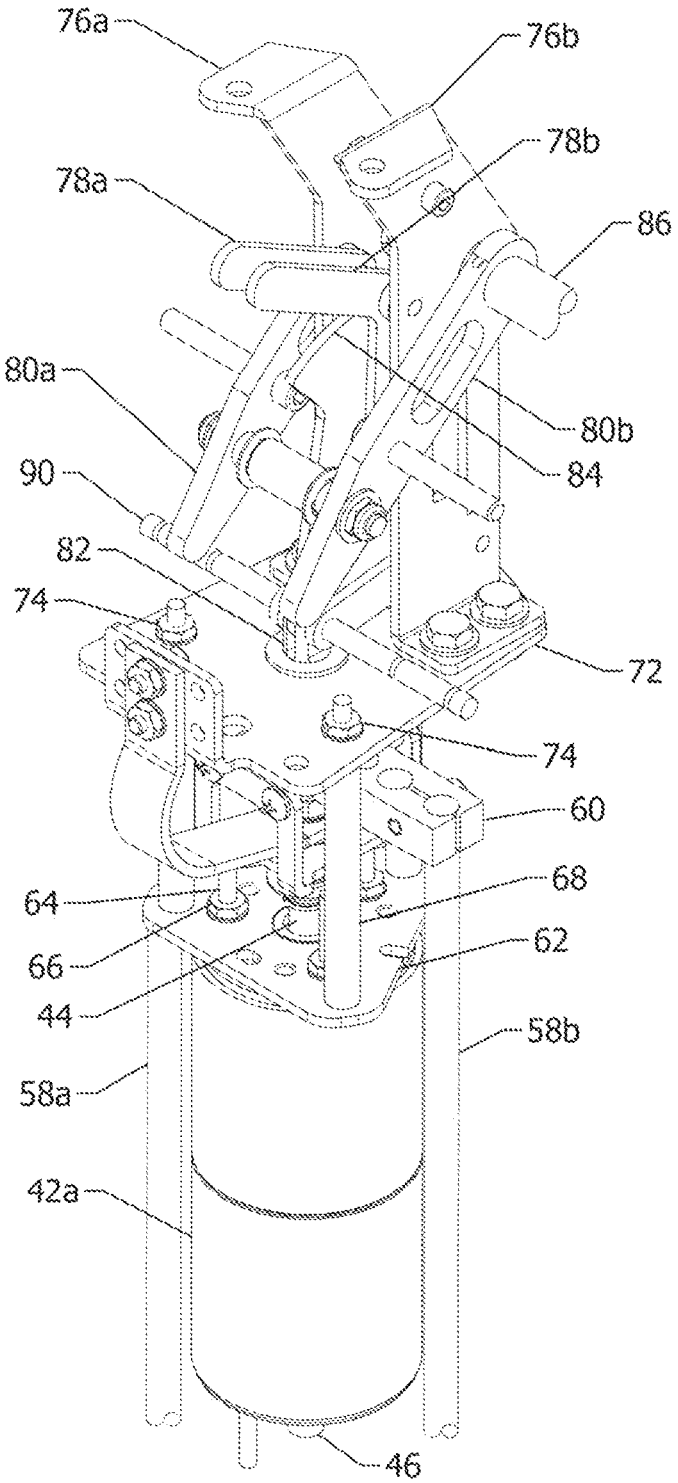
FIG. 10 is a perspective view of a portion of the actuating mechanism of FIG. 4 affixed to a vacuum bottle positioned at the top of the stack of bottles.
Figure 11:
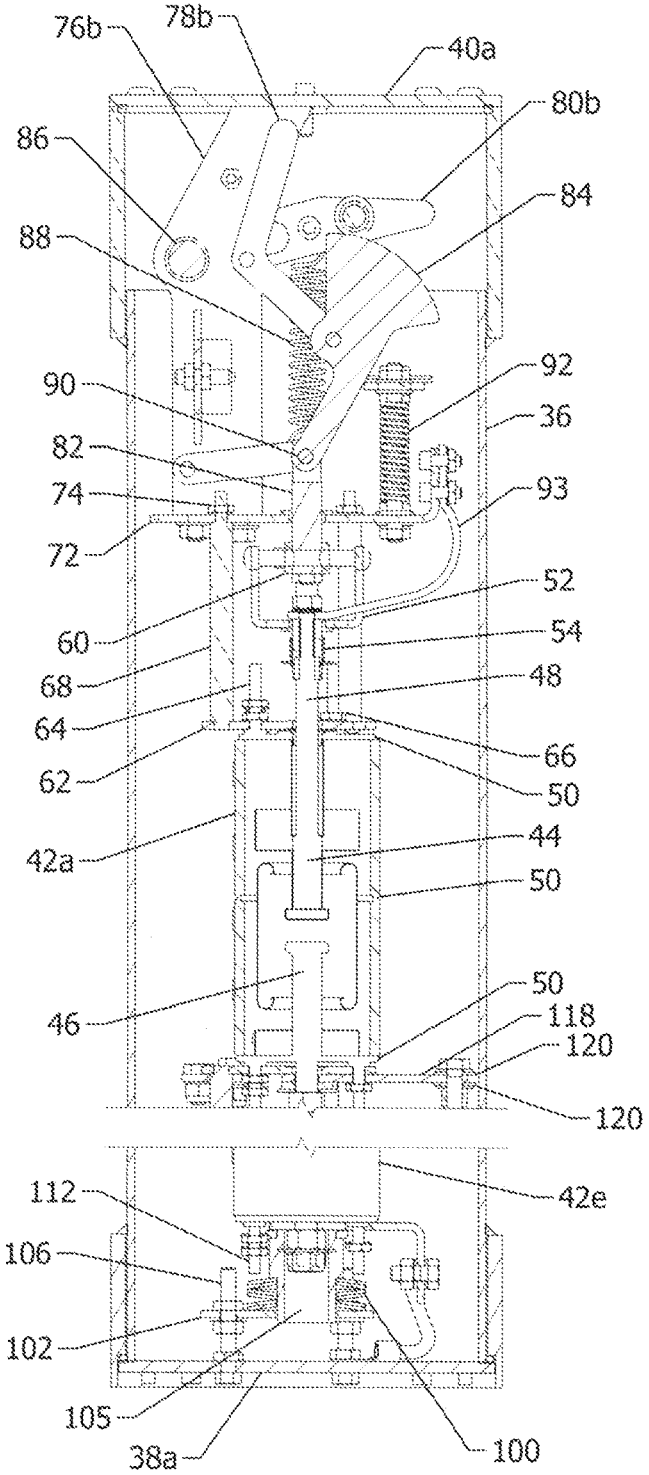
FIG. 11 is an enlarged side elevation view of the interrupter of the present invention broken away to reveal the contacts within a vacuum bottle and the cushion spring located at the lower portion of the vacuum bottle stack.
Figure 13:
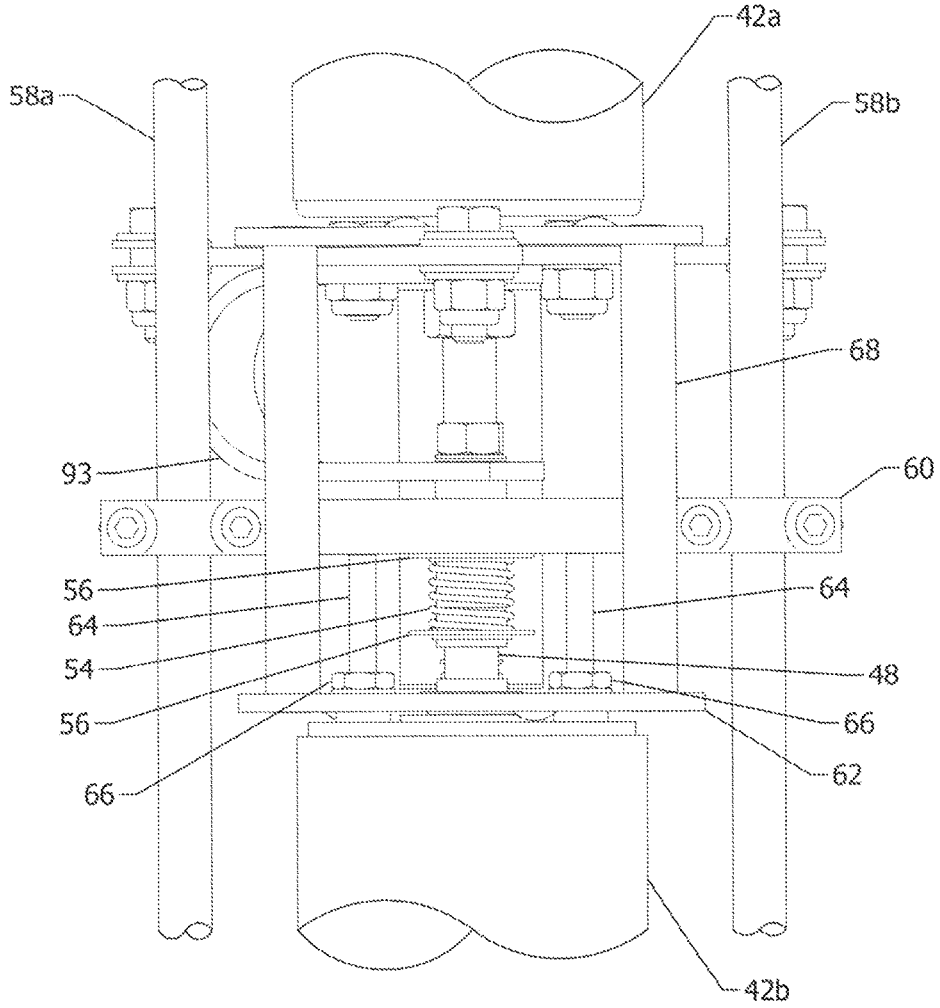

FIGS. 2-11 show the vacuum interrupter 32 of the present invention. The interrupter 32 includes as typical of such vacuum interrupter assemblies an insulating elongated housing or tube 36 which is made of dielectric material such as fiberglass, for example. The insulating tube 36 is attached at the lower end 31 to bottom housing 38 and at the upper end 30 to top housing 40. As can be seen from FIGS. 2-4, the bottom housing 38 and the top housing 40 is typically bowl or cup shaped. A plurality of cylindrical vacuum bottles 42*a*, 42*b*, 42*c*, 42*d*, and 42*e* are in stacked arrangement such as shown in FIG. 3, for example. They are mechanically coupled together as shown in for example in FIG. 3 where five such bottles are depicted as being ganged together; there could of course be more or less bottles as is known in the art. Each of the vacuum bottles 42*a*, 42*b*, 42*c*, 42*d* and 42*e* has a pair of contact rods 44 and 46, as shown in FIGS. 10 and 11. The lower contact rods 46 are stationary and extend through the bottom of the bottles. The upper contact rods 44 are axially movable and their upper ends 48 extend from the top of the bottles as shown in FIG. 11, for example. The outer housing of the vacuum bottles 42*a*, 42*b*, 42*c*, 42*d* and 42*e* is ceramic. The typical location for braze joints 50 of the bottles are shown in FIG. 11. As shown in FIGS. 11 and 13 the upper end 48 of the axially movable contact rod 44 carries a contact wipe spring holder 52. The contact wipe spring holder 52 carries contact wipe spring 54 between wipe spring washers 56, as shown in FIG. 13. A pair of side rods 58*a*, 58*b* which extend virtually the length of the insulating tube 36, as shown in FIGS. 3 and 10, have attached a cross bar 60 between each of the bottles as shown in FIG. 3. Also, at the upper end of each bottle is an upper bottle support plate 62, as shown in FIGS. 10 and 11, attached to the upper end of each bottle via upper bottle support plate threaded studs 64 extending through holes in the support plate 62. The vacuum bottle is attached to the upper support plate 62 by upper support plate nut 66. For the uppermost bottle 42*a* the support posts 68 are positioned between the upper bottle support plate 62 and an actuator mechanism bottom plate 72 and attached thereto by actuator bottom plate nuts 74, as shown in FIG. 10. Also, the actuator mechanism bottom plate 72 carries in spaced parallel arrangement actuator mechanism side plates 76*a*, 76*b* which are each attached to top plate 40*a* as shown in FIGS. 4 and 8. Upper toggle link assembly 78*a*, 78*b* is pivotally carried between the parallel actuator mechanism side plates 76*a*, 76*b* as shown in FIG. 10. An actuating lever assembly 80*a*, 80*b* is attached to the outside of the parallel actuator mechanism side plates 76*a*, 76*b*. The actuator mechanism output rod 82 is coupled to actuator link 84 as shown in FIGS. 10 and 11. The bottom of the actuator mechanism output rod 82 is attached to top most cross bar 60, as shown in FIGS. 10 and 11. An actuating arm shaft 86, as shown in FIGS. 10 and 11, is held in position between the actuator mechanism side plates 76*a*, 76*b*. A set of movable contact opening springs 88, as shown in FIG. 8, are each attached at one end to actuating lever assembly 80*a*, 80*b* and at the other end to trip spring pin 90. Push-thru spring 92 is attached to the mechanism support plate 72 as shown in FIGS. 4 and 11 and allows the blade 18 and arc horn 34 to push past the actuating arm 28 as the blade closes so it is reset for the next opening operation. Copper conductor straps 93 electrically interconnect all of the vacuum bottles 42*a*-42*e* and the mechanism bottom plate 72 via shaft 86 to actuating arm 28. The bottom vacuum bottle is electrically connected to lower end 31 which is connected to the switch terminal 25 as shown in FIG. 1. When switch blade 18 opens the current to be interrupted passes from blade 18 into actuating arm 28 into bottle moving contacts 44, through stationary contacts 46, into lower end 31, into the switch terminal 25, thus interrupting the arcs as the contacts part in vacuum. When the actuator mechanism output rod 82 is caused to moved up by the movement the actuator arm 28 caused by the opening of the switch 10 the toggle 78*a*, 78*b* will rock and cause the cross bar 60 between each vacuum bottle to rise causing all of the upper movable contact rods 44 in the bottles to move simultaneously to the open position to cause a gap in each of the vacuum bottles 42*a*-42*e* thereby resulting in arc extinguishment. The vacuum interrupter 32 described thus far is fairly conventional.

Figure 12:
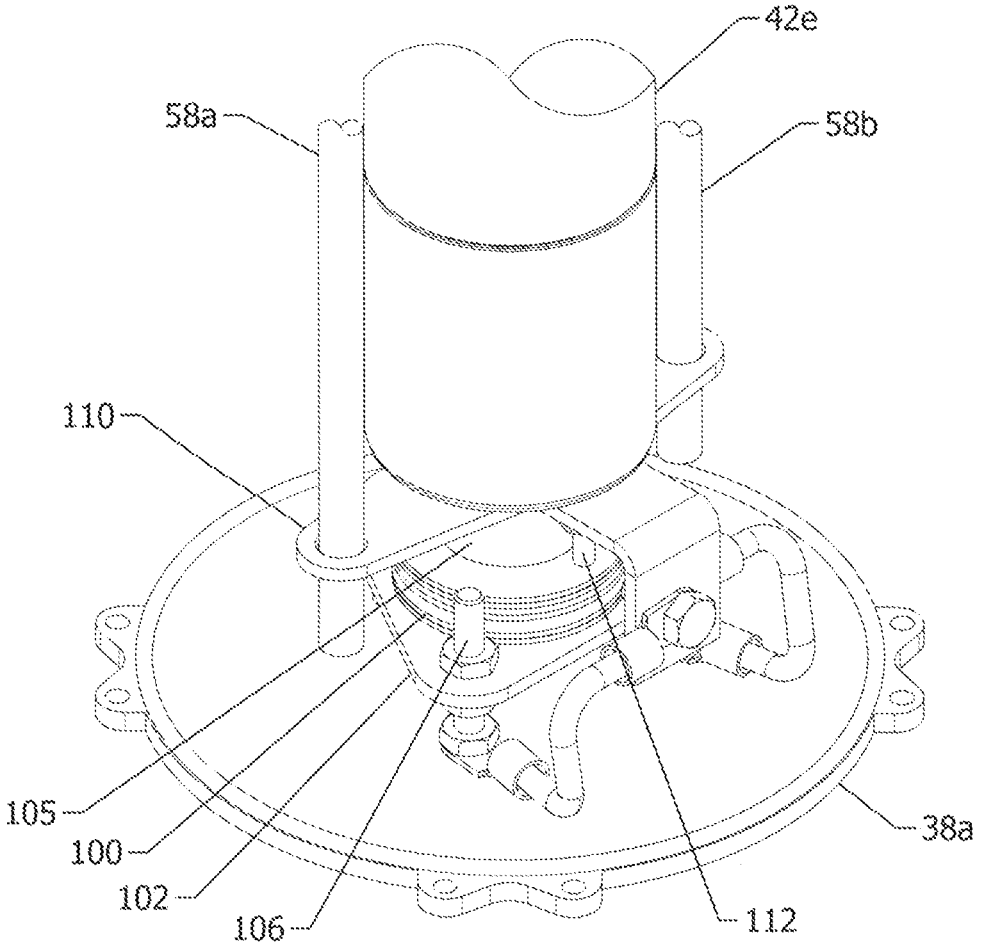
FIG. 12 is a perspective of the cushion spring assembly of the present invention; and, FIG. 13 is an enlarged elevation view of the components between the upper end of the vacuum bottle 42*b* and lower end of the vacuum bottle 42*a* as shown in FIG. 3.

One aspect of the present invention is the use of a cushion spring 100, as shown in FIGS. 3, 11, and 12, for example. With reference to FIG. 12, the cushion spring mechanism includes cushion spring plate 102 that has bottom plate studs 106 and cushion spring holder 105. The cushion spring 100 is composed of a series of belleville type springs that apply compressive load to the stack of vacuum bottles. The spring load is supplied between bottom cover plate 38*a* and upper cover plate 40*a*. The moveable cushion spring holder 105 bears on the bottom of the lower most vacuum bottle 42*e*, as shown in FIGS. 11 and 12. The cushion spring holder 105 passes through and is centered on bottom plate 102 as shown in FIG. 12. A ladder linkage guide plate 110 serves as a guide for moving rods 58*a*, 58*b*. The ladder linkage guide plate is 110 is attached to the bottom of the lower most vacuum bottle 42*e* via bottom studs 112 as can be seen from FIG. 11. The cushion spring 100 is preferably a belleville spring which comprises a plurality of frusto-conical shaped washers. Thus, the gang of vacuum bottles 42*a*-42*e* which are mechanically coupled to each other as a unit are supported axially at the bottom by the cushion spring mechanism of the present invention. The bottles are bolted together and the top bottle 42*a* is attached to the upper bottle support plate 62 which is attached to top plate 40*a* via posts 68 and the side plates 76*a* and 76*b*, as shown in FIGS. 4, 10 and 11. The cushion spring 100 holds the coupled bottles in axial compression which assures that the braze joints 50 of the individual bottles are not loaded in tension during operation of the interrupter to open and close the contacts at high speed. This is important to prevent leaks in the vacuum tight joints of each bottle due to tensile loads. If the vacuum is lost or slowly leaks the interrupter 32 will fail. The cushion spring 100 also isolates the bottles from shock loads during shipping. The above description of the components of the over toggle trip mechanism serves only to understand how the non-moving parts are used to load the bottles axially in compression via the belleville cushion springs, so that the braze joints never see a tensile load. In summary, the cushion spring 100 is supported by the bottom cover 38*a* and the cushion springs load the bottom of the lower bottle and upper bottles through the posts 68 to the side plates 76*a* and 76*b* to the top cover 40*a* which puts tensile load on tube 36 keeping a compressive load on the braze joints 50.

An interrupter centering assembly 116 is also preferably included and positioned between each of the bottles 42*a*-42*e* as shown in FIG. 4. The interrupter centering assembly has three arms 118 having slidable ring-shaped members 120 at the distal end of each arm 118 for contacting the inner surface of the insulating tube 36, as shown in FIG. 11. The ring-shaped member 120 are slidable on the inner surface of the insulating tube 36 with little friction. The ring-shaped members 120 may be made of nylon washers, for example. This arrangement provides lateral support for the coupled bottles 42*a*-42*e* within the tube and also permits axial movement of the bottles during flexing of the cushion spring.

Another aspect of the present invention includes a membrane vent 94, as shown in FIG. 7, which preferably includes an air permeable hydrophobic membrane 96 which is enclosed within the membrane vent housing 98 passing through for example the top housing 40 of the interrupter 32. The membrane 96 could also be oleophobic in addition to air permeable hydrophobic if oils are a concern. Of course the membrane vent 94 might be placed also in the bottom housing 38 or in the wall of the insulating tube 36. The membrane vent 94 may be such as is marketed as a GORE vent. "GORE" is a U.S. registered trademark of W. L. Gore & Associates, Inc., 555 Paper Mill Road, Newark, Del. 19714. Such a type of membrane vent plug is also described in U.S. Pat. No. 8,734,573 B2, issued May 27, 2014, to Masashi Ono, et al. and assigned to W. L. Gore & Associates, Co., Ltd., Tokyo, Japan. As mentioned with the use of the membrane vent 94, the moisture inside the vacuum interrupter 32 insulating tube 36 is controlled. This is an improvement over prior art interrupters where gas or liquid which can leak out of the tube over time to cause voltage failure within the tube from water condensation. The membrane vent 94 permits the insulating medium to be just ambient air itself, but the air within the tube 36 is condensation controlled at all times during all conditions as a result of the desirable effects of the vent 94. A further benefit of the membrane vent 94 is that the vent keeps the pressure inside the insulating tube 36 equal to the pressure outside the tube thus the tube housing seals are not stressed.

The membrane 96 allows water vapor to flow in or out of the insulating tube, but the flow-in is so slow that warm humid air does not condense on a cold vacuum bottle surface inside the insulating tube as shown by repeated tests in an environmental chamber. Conversely, if warm humid air is in the insulating tube 36, and then cold air with low humidity hits the tube, the membrane vent 94 will exhaust the warm humid air before the bottles 42*a*-42*e* can get cold enough to cause condensation to occur.

What is claimed is:

1. A high voltage vacuum load interrupter for use with a high voltage air break disconnect switch, the high voltage vacuum load interrupter comprising:

an insulating elongated housing of dielectric material having a first end cap and a second end cap sealed to opposite ends thereof;

at least one vacuum bottle electric interrupter positioned within the insulating elongated housing and having a fixed contact and a movable contact axially aligned with the fixed contact, the axially aligned movable contact being movable between a closed position engageable with the fixed contact and an open position spaced from the fixed contact;

an operating mechanism coupled to the moveable contact and secured to one of the opposite ends of the elongated housing, the operating mechanism including:

an actuator;

a toggle pivotable by the actuator;

an actuating lever assembly operable with the toggle to reciprocate the movable contact;

a trip spring means for causing the moveable contact to move to the open position upon actuation by the actuator;

means for causing the moveable contact to move to the closed position after actuation;

means for holding the axially aligned movable contact and the fixed contact in the closed position when the interrupter is not actuated by the actuator; and, means for preventing electrical flash over within the insulating elongated housing and for preventing stressing of a sealing of the insulating elongated housing by enabling an insulating medium consisting of atmospheric air within the insulating elongated housing exterior to the at least one vacuum bottle electric interrupter that is desiccant free and has a pressure equal to the pressure outside of the insulating elongated housing, said means for preventing electrical flash over within the insulating elongated housing and for preventing stressing of the sealing of the insulating elongated housing comprising at least one air permeable membrane vent including a membrane vent housing in operative engagement with an opening in and mounted to at least one of the first end cap, the second end cap and the insulating elongated housing, the at least one air permeable membrane vent comprising an air permeable hydrophobic membrane in operative arrangement with the membrane vent housing configured to prevent the at least one vacuum bottle electric interrupter from electric flashover by preventing condensation on the at least one vacuum bottle electric interrupter while simultaneously not stressing the sealing of the insulating elongated housing by controlling the pressure within the insulating elongated housing exterior to the at least one vacuum bottle electric interrupter equal to the pressure outside of the insulating elongated housing, thereby preventing stress of the sealing of the insulating elongated housing.

2. The high voltage vacuum load interrupter of claim 1, comprising at least two vacuum bottle electric interrupters stacked one above the other including an upper most vacuum bottle electric interrupter and a lower most vacuum bottle electric interrupter, the stack of vacuum bottles is supported from the top by one of the opposite ends of the insulating elongated housing and each of the at least two vacuum bottle electric interrupters is axially aligned with every other vacuum bottle electric interrupter, further comprising a cushion spring assembly in operative arrangement with the stack of at least two vacuum bottle electric interrupters housed within the insulating elongated housing for exerting a compressive force on the stack of at least two vacuum bottle electric interrupters, the cushion spring assembly operatively positioned exteriorly of the stack of the at least two vacuum bottle electric interrupters within the elongated housing and in operative direct spring contact with a bottom of the lower most vacuum bottle electric interrupter of the stack, wherein the stack of the at least two vacuum bottle electric interrupters is configured to be maintained in compression between the cushion spring assembly and the one opposite end of the elongated housing, whereby tension loads on any braze joints of each of the vacuum bottle electric interrupters is prevented and each of the vacuum bottle electric interrupters is isolated from shock loads during shipping.

3. The high voltage vacuum load interrupter of claim 1, wherein the air permeable hydrophobic membrane is also configured to be oleophobic.

4. The high voltage vacuum load interrupter of claim 1, comprising at least two vacuum bottle electric interrupters stacked one above the other including an upper most vacuum bottle electric interrupter and a lower most vacuum bottle electric interrupter and further including a centering assembly operatively positioned between each of the at least two vacuum bottle electric interrupters, the centering assembly including a plurality of arms each having at a distal end thereof a slidable ring-shaped member configured to slidably contact an inner surface of the elongated housing for providing lateral support for the at least two vacuum bottle electric interrupters.

5. The high voltage vacuum load interrupter of claim 4, wherein the ring-shaped members comprise nylon washers.

6. The high voltage vacuum load interrupter of claim 1, wherein an outer housing of the at least one vacuum bottle electric interrupter is ceramic.

* * * * *